US010054115B2

(12) United States Patent
Seith

(10) Patent No.: US 10,054,115 B2
(45) Date of Patent: Aug. 21, 2018

(54) DIAPHRAGM PUMP WITH AUTOMATIC PRIMING FUNCTION

(71) Applicant: Ingersoll-Rand Company, Davidson, NC (US)

(72) Inventor: Warren Andrew Seith, Bethlehem, PA (US)

(73) Assignee: Ingersoll-Rand Company, Davidson, NC (US)

( * ) Notice: Subject to any disclaimer, the term of this patent is extended or adjusted under 35 U.S.C. 154(b) by 752 days.

(21) Appl. No.: 13/763,926

(22) Filed: Feb. 11, 2013

(65) Prior Publication Data

US 2014/0227110 A1 Aug. 14, 2014

(51) Int. Cl.
*F04B 43/073* (2006.01)
*F04B 9/135* (2006.01)
*F04B 43/00* (2006.01)

(52) U.S. Cl.
CPC ..... *F04B 43/0736* (2013.01); *F04B 9/135* (2013.01); *F04B 43/0081* (2013.01); *F04B 2201/0201* (2013.01); *F04B 2201/0206* (2013.01)

(58) Field of Classification Search
CPC ..... F04B 2201/0201; F04B 2201/0206; F04B 43/081; F04B 43/0736; F04B 9/135
USPC ..... 417/12, 18, 46, 53, 393, 395
See application file for complete search history.

(56) References Cited

U.S. PATENT DOCUMENTS 5,035,583 A 7/1991 Vaught
5,047,950 A * 9/1991 Fritsch ..... G01F 3/20 702/47
5,257,914 A 11/1993 Reynolds
5,816,778 A 10/1998 Elsey, Jr. et al.
6,106,238 A * 8/2000 Ciavarini et al. ..... 417/53
6,126,403 A 10/2000 Yamada
6,241,487 B1 6/2001 Reynolds
6,402,486 B1 6/2002 Steck et al.
6,554,578 B1 4/2003 Siegel
6,957,952 B1 10/2005 Steck et al.
(Continued)

FOREIGN PATENT DOCUMENTS

DE 19826610 A1 12/1999
DE 20104631 U1 7/2001
WO 2011106557 A1 9/2011

OTHER PUBLICATIONS

Linde Hydraulics, HPR-02 Self-Regulating Pump for Open Loop Operation, pp. 1-32.

(Continued)

*Primary Examiner* — Kenneth J Hansen
(74) *Attorney, Agent, or Firm* — Barnes & Thornburg LLP

(57) ABSTRACT

Illustrative embodiments of diaphragm pumps having an automatic priming function, as well as related systems and methods, are disclosed. In one illustrative embodiment, a method of priming a diaphragm pump includes sensing, with a pressure sensor disposed at a fluid outlet of the diaphragm pump, a pressure of a fluid being pumped by the diaphragm pump, transmitting a pressure signal associated with the sensed pressure from the pressure sensor to a controller of the diaphragm pump, and identifying, on the controller, whether the diaphragm pump is primed by determining whether a characteristic of the pressure signal has reached a threshold.

12 Claims, 6 Drawing Sheets

(56) References Cited

U.S. PATENT DOCUMENTS

| | | | | |
|---|---|---|---|---|
| 7,407,371 | B2 | 8/2008 | Leone et al. | |
| 7,458,309 | B2 | 12/2008 | Simmons et al. | |
| 7,517,199 | B2 | 4/2009 | Reed et al. | |
| 7,658,598 | B2 | 2/2010 | Reed et al. | |
| 7,690,897 | B2 | 4/2010 | Branecky et al. | |
| 7,901,190 | B2 | 3/2011 | Gray | |
| 7,931,447 | B2 | 4/2011 | Levin et al. | |
| 8,177,519 | B2 | 5/2012 | Branecky | |
| 2006/0104829 | A1 | 5/2006 | Reed et al. | |
| 2007/0092386 | A1* | 4/2007 | Reed et al. | 417/395 |
| 2007/0154321 | A1 | 7/2007 | Stiles, Jr. et al. | |
| 2009/0016901 | A1 | 1/2009 | Morris, III | |
| 2009/0151801 | A1 | 6/2009 | Gorman et al. | |
| 2010/0196168 | A1* | 8/2010 | Kozumplik et al. | 417/1 |
| 2011/0002792 | A1 | 1/2011 | Bartos et al. | |
| 2011/0142688 | A1 | 6/2011 | Chappel et al. | |
| 2012/0051945 | A1* | 3/2012 | Orndorff et al. | 417/53 |

OTHER PUBLICATIONS

European Patent Office, International Search Report and Written Opinion for PCT/US2014/013994, dated May 12, 2014, 11 pages.

* cited by examiner

DIAPHRAGM PUMP WITH AUTOMATIC PRIMING FUNCTION

TECHNICAL FIELD

The present disclosure relates, generally, to diaphragm pumps and, more particularly, to diaphragm pumps having an automatic priming function.

BACKGROUND

Diaphragm pumps may occasionally be disconnected from their fluid sources. Upon reconnecting the pump, it must be primed in order to remove air from the plumbing connections and to prepare the pump for immediate delivery of pumped fluid when operated. Prior pump systems have typically implemented a priming function by operating the pump for a set period of time. Such priming functions, however, do not reliably achieve prime. For instance, the pump may not actually achieve prime during the set period of time, in which case the priming function has failed. Alternatively, the pump may achieve prime before the end of the set period of time, in which case excess fluid will be pumped downstream and wasted.

SUMMARY

According to one aspect, a pump system may comprise a diaphragm pump including (i) a shaft coupled to a diaphragm and configured to move reciprocally between a first end-of-stroke position and a second end-of-stroke position, (ii) a stroke sensor configured to sense whether the shaft has reached one of the first and second end-of-stroke positions, (iii) a pressure sensor disposed at a fluid outlet of the diaphragm pump and configured to sense a pressure of a fluid pumped by the diaphragm pump, and (iv) a solenoid valve configured to control supply of a motive fluid that causes the shaft to move between the first and second end-of-stroke positions; and a controller communicatively coupled to the diaphragm pump and configured to (i) identify whether the shaft has reached one of the first and second end-of-stroke positions using a stroke signal received from the stroke sensor, (ii) identify whether the diaphragm pump is primed by determining whether a characteristic of a pressure signal received from the pressure sensor has reached a threshold, and (iii) transmit a control signal to the solenoid valve in response to identifying that the shaft is in one of the first and second end-of-stroke positions and that the diaphragm pump is not primed, the control signal actuating the solenoid valve such that the motive fluid causes the shaft to move between the first and second end-of-stroke positions.

In some embodiments, the controller may be configured to determine whether the characteristic of the pressure signal has reached the threshold by determining whether at least one of a differential, an average, a rolling average, a peak value, and an amplitude of the pressure signal has reached the threshold. The controller may be configured to determine whether the characteristic of the pressure signal has reached the threshold in response to identifying that the shaft has reached one of the first and second end-of-stroke positions.

In some embodiments, the controller may be further configured to track a number of strokes of the shaft using the stroke signal received from the stroke sensor and transmit the control signal to the solenoid valve in response to identifying (i) that the shaft is in one of the first and second end-of-stroke positions, (ii) that the diaphragm pump is not primed, and (iii) that the number of strokes of the shaft has not exceeded a stroke limit. The controller may be configured to transmit the control signal to the solenoid valve in response to identifying (i) that the shaft is in one of the first and second end-of-stroke positions, (ii) that the diaphragm pump is not primed, and (iii) that a timer of the controller has not exceeded a time limit.

According to another aspect, a method of priming a diaphragm pump may include sensing whether a shaft coupled to a diaphragm has reached an end-of-stroke position using a stroke sensor of the diaphragm pump; identifying, on a controller of the diaphragm pump, whether the shaft is in the end-of-stroke position using a stroke signal generated by the stroke sensor; sensing a pressure of a pumped fluid at a fluid outlet of the diaphragm pump using a pressure sensor disposed at the fluid outlet; identifying, on the controller, whether the diaphragm pump is primed by determining whether a characteristic of a pressure signal generated by the pressure sensor has reached a threshold; and actuating a solenoid valve, in response to identifying that the shaft is in the end-of-stroke position and that the diaphragm pump is not primed, to cause a motive fluid to be supplied to the diaphragm such that the shaft moves from the end-of-stroke position.

In some embodiments, actuating the solenoid valve may include actuating the solenoid valve in response to identifying (i) that the shaft is in the end-of-stroke position, (ii) that the diaphragm pump is not primed, and (iii) that a number of strokes of the shaft has not exceeded a stroke limit. The method may further include executing, on the controller, an alarm protocol in response to identifying that the diaphragm pump is not primed and that the number of strokes of the shaft has exceeded the stroke limit.

In some embodiments, actuating the solenoid valve may include actuating the solenoid valve in response to identifying (i) that the shaft is in the end-of-stroke position, (ii) that the diaphragm pump is not primed, and (iii) that a timer of the controller has not exceeded a time limit. The method may further include executing, on the controller, an alarm protocol in response to identifying that the diaphragm pump is not primed and that the timer of the controller has exceeded the time limit. Determining whether the characteristic of the pressure signal has reached the threshold may include determining whether at least one of a differential, an average, a rolling average, a peak value, and an amplitude of the pressure signal has reached the threshold.

According to yet another aspect, a method of priming a diaphragm pump may include sensing, with a pressure sensor disposed at a fluid outlet of the diaphragm pump, a pressure of a fluid being pumped by the diaphragm pump; transmitting a pressure signal associated with the sensed pressure from the pressure sensor to a controller of the diaphragm pump; and identifying, on the controller, whether the diaphragm pump is primed by determining whether a characteristic of the pressure signal has reached a threshold.

In some embodiments, the method may further include ceasing to pump the fluid with the diaphragm pump in response to identifying that the diaphragm pump is primed. The method may further include pumping fluid at a non-uniform flow rate, with the diaphragm pump, through the fluid outlet in response to identifying that the diaphragm pump is not primed. The method may further include pumping fluid, with the diaphragm pump, through the fluid outlet in response to identifying that the diaphragm pump is not primed and that a timer of the controller has not exceeded a time limit. The method may further include ceasing to pump the fluid with the diaphragm pump in response to identifying that the timer of the controller has exceeded the time limit.

In some embodiments, the method may further include tracking, on the controller, a number of strokes of a shaft of the diaphragm pump and pumping fluid, with the diaphragm pump, through the fluid outlet in response to identifying that the diaphragm pump is not primed and that the number of strokes has not exceeded a stroke limit. The method may further include ceasing to pump the fluid with the diaphragm pump in response to identifying that the number of strokes has exceeded the stroke limit. The method may further include executing, on the controller, an alarm protocol in response to identifying that the diaphragm pump is not primed and that the number of strokes has exceeded the stroke limit. Determining whether the characteristic of the pressure signal has reached the threshold may include determining whether at least one of a differential, an average, a rolling average, a peak value, and an amplitude of the pressure signal has reached the threshold.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
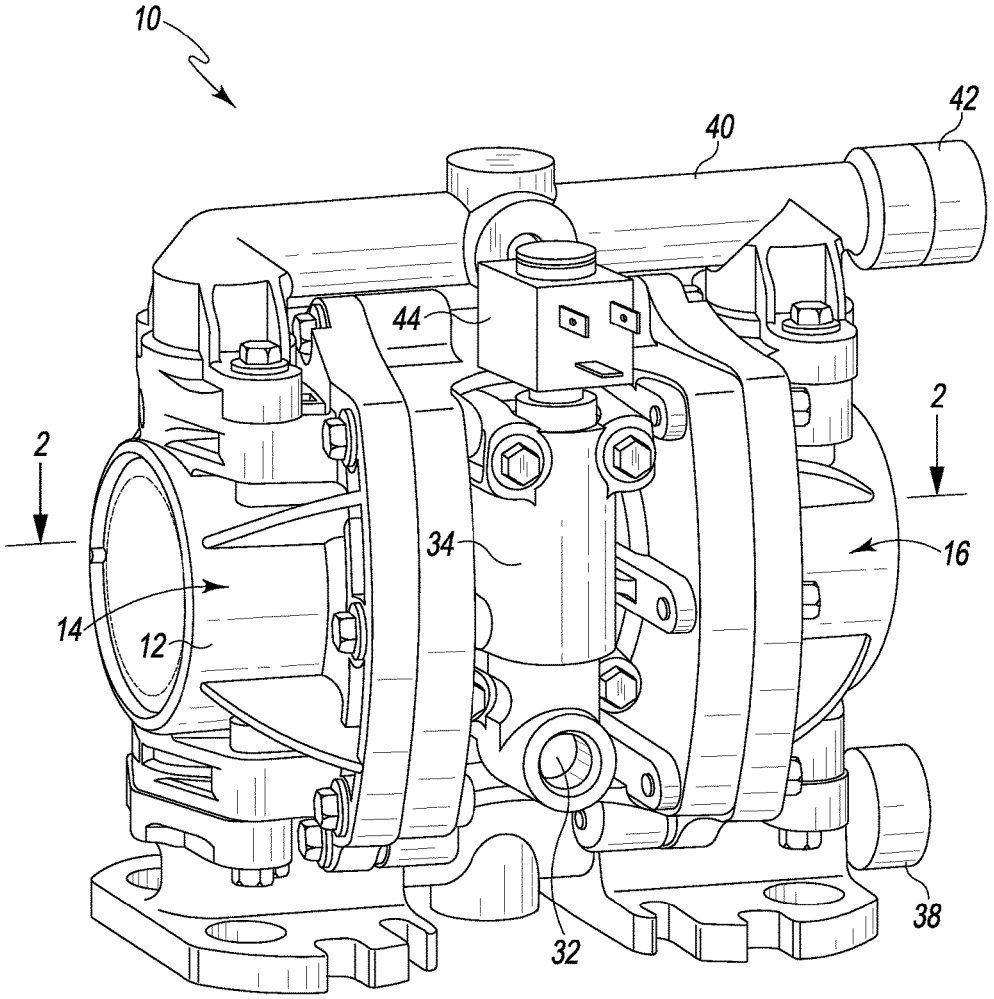
FIG. 1 is a front perspective view of at least one embodiment of a double diaphragm pump.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Figure 2:
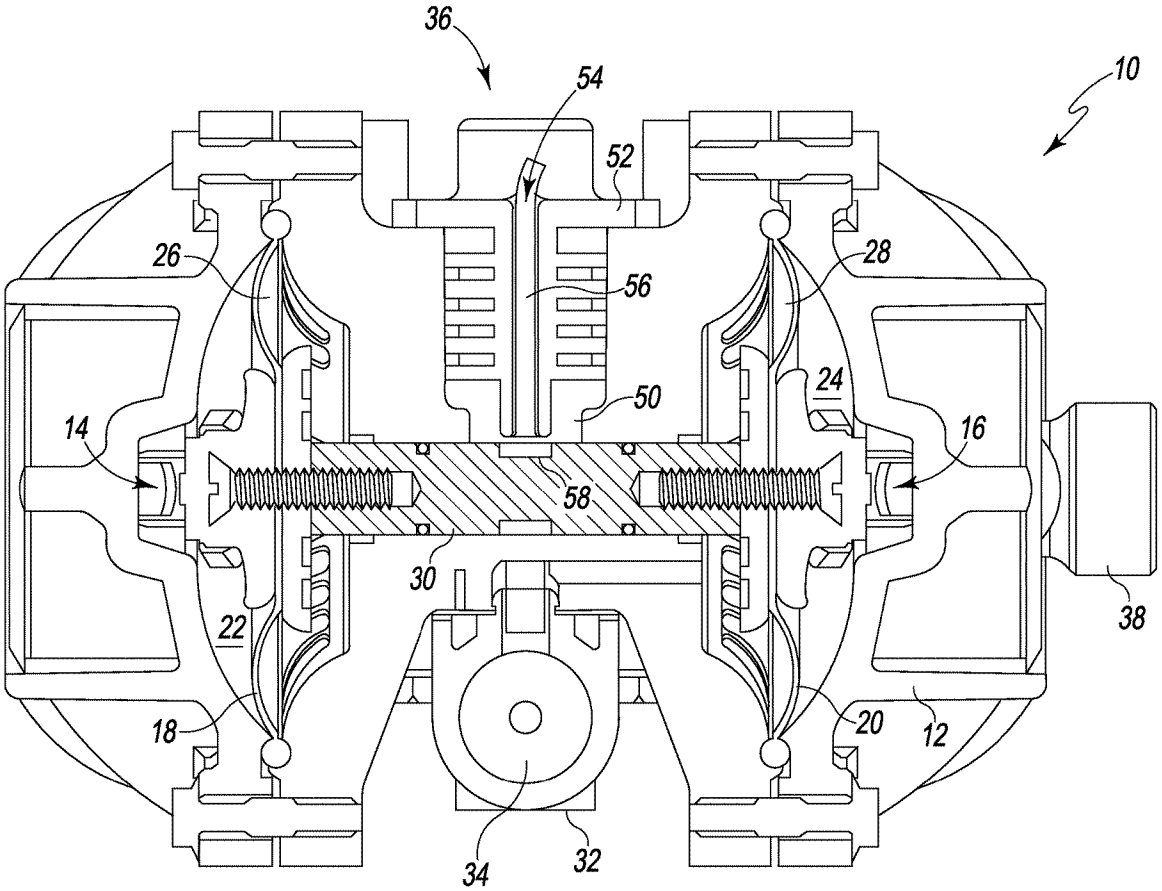
FIG. 2 is a cross-sectional view of the pump of FIG. 1, taken along the line 2-2 in FIG. 1.

Referring now to FIGS. 1 and 2, a diaphragm pump 10 is shown. The pump 10 of FIGS. 1 and 2 is illustratively embodied as a double-diaphragm pump. It is contemplated that, in other embodiments, the pump 10 may be embodied as any other type of diaphragm pump. In the illustrative embodiment, the pump 10 has a housing 12 that defines a first working chamber 14 and a second working chamber 16. In the illustrative embodiment, the housing 12 is comprised of three sections coupled together by fasteners. As best seen in FIG. 2, the first and second working chambers 14, 16 of the pump 10 are each divided with respective first and second flexible diaphragms 18, 20 into respective first and second pump chambers 22, 24 and first and second motive fluid chambers 26, 28. The diaphragms 18, 20 are interconnected by a shaft 30, such that when the diaphragm 18 is moved to increase the volume of the associated pump chamber 22, the other diaphragm 20 is simultaneously moved to decrease the volume of the associated pump chamber 24, and vice versa.

The shaft 30 illustrated in FIG. 2 is a reciprocating diaphragm link rod having a fixed length, such that the position of the shaft 30 in the pump 10 is indicative of the position of the diaphragms 18, 20. The shaft 30 and diaphragms 18, 20 move back and forth a fixed distance that defines a stroke. The fixed distance is determined by the geometry of the pump 10, the shaft 30, the diaphragms 18, 20, and other components of the pump 10 (e.g., the diaphragm washers). A stroke is defined as the travel path of the shaft 30 between first and second end-of-stroke positions. Movement of the shaft 30 from one end-of-stroke position to the other end-of-stroke position and back defines a cycle of operation of the shaft 30 (i.e., a cycle includes two consecutive strokes).

The pump 10 includes an inlet 32 for the supply of a motive fluid (e.g., compressed air, or another pressurized gas) and a major valve 34 for alternately supplying the motive fluid to the first and second motive fluid chambers 26, 28 to drive reciprocation of the diaphragms 18, 20 and the shaft 30. When the major valve 34 supplies motive fluid to the motive fluid chamber 26, the major valve 34 places an exhaust assembly 36 in communication with the other motive fluid chamber 28 to permit motive fluid to be expelled therefrom. Conversely, when the major valve 34 supplies motive fluid to the motive fluid chamber 28, the major valve 34 places the motive fluid chamber 26 in communication with the exhaust assembly 36. In the illustrative embodiment of the pump 10, movement of the major valve 34 between these positions is controlled by a solenoid valve 44. As such, by controlling movement of the major valve 34, the solenoid valve 44 of the pump 10 controls the supply of the motive fluid to the first and second motive fluid chambers 26, 28.

The exhaust assembly 36 of the pump 10 includes an exhaust chamber 50 and a muffler 52 that is received in the exhaust chamber 50. The exhaust assembly 36 may have a design similar to the exhaust system described in U.S. patent application Ser. No. 13/741,057 to Treml et al., the entire disclosure of which is incorporated by reference herein. In the illustrative embodiment shown in FIG. 2, the muffler 52 includes a sensor mounting chamber 54 formed therein, and a stroke sensor 56 is disposed within the sensor mounting chamber 54. The stroke sensor 56 is illustratively embodied as a proximity sensor that detects the presence or absence of material (or a particular type of material) within a certain distance of the sensor. The shaft 30 may include one or more features that are detectable by the stroke sensor 56 when the shaft 30 reciprocates between the first and second end-of-stroke positions. In the illustrative embodiment shown in FIG. 2, the shaft 30 includes a central notch 58 where the shaft 30 has a smaller diameter. In this embodiment, the stroke sensor 56 will not be triggered when the shaft 30 is in a centered position within the pump 10 (i.e., the position shown in FIG. 2), as no material is present within the sensing field of the stroke sensor 56. As the shaft 30 moves toward one of the end-of-stroke positions, the material of a larger diameter portion of the shaft 30 will enter the sensing field of the stroke sensor 56 and trigger the stroke sensor 56.

Other possible configurations for the shaft 30 that may be sensed by the stroke sensor 56 are described in U.S. Patent Application Publication No. 2010/0196168 to Kozumplik et al., the entire disclosure of which is incorporated by reference herein.

It is contemplated that, in other embodiments of the pump 10, the stroke sensor 56 may be any type of sensor capable of sensing whether the shaft 30 has reached one of the first and second end-of-stroke positions and may be positioned in any number of locations within the pump 10. For instance, in some embodiments, the stroke sensor 56 may be a pressure switch fluidly coupled to a pilot valve (not shown) of the pump 10. In such embodiments, the stroke sensor 56 may measure a pressure at the pilot valve of the pump 10 to determine whether the shaft 30 has reached one of the first and second end-of-stroke positions. In still other embodiments of the pump 10, the stroke sensor 56 may be embodied as an optical sensor capable of sensing whether the shaft 30 has reached one of the first and second end-of-stroke positions. It will be appreciated that the foregoing examples (i.e., a proximity sensor, a pressure sensor, and an optical sensor) are merely illustrative and should not be seen as limiting the stroke sensor 56 to any particular type of sensor.

During operation of the pump 10, as the shaft 30 and the diaphragms 18, 20 reciprocate, the first and second pump chambers 22, 24 alternately expand and contract to create respective low and high pressure within the respective first and second pump chambers 22, 24. The pump chambers 22, 24 each communicate with an inlet manifold 38 that may be connected to a source of fluid to be pumped and also each communicate with an outlet manifold, or fluid outlet, 40 that may be connected to a receptacle for the fluid being pumped. Check valves (not shown) ensure that the fluid being pumped moves only from the inlet manifold 38 toward the outlet manifold 40. For instance, when the pump chamber 22 expands, the resulting negative pressure draws fluid from the inlet manifold 38 into the pump chamber 22. Simultaneously, the other pump chamber 24 contracts, which creates positive pressure to force fluid contained therein into the outlet manifold 40. Subsequently, as the shaft 30 and the diaphragms 18, 20 move in the opposite direction, the pump chamber 22 will contract and the pump chamber 24 will expand (forcing fluid contained in the pump chamber 24 into the outlet manifold 40 and drawing fluid from the inlet manifold 38 into the pump chamber 24). The pump 10 also includes a pressure sensor 42 connected to, or forming a part of, the outlet manifold 40. The pressure sensor 42 may be embodied as any type of sensor capable of determining a pressure of a fluid being pumped through the fluid outlet 40.

Figure 3:
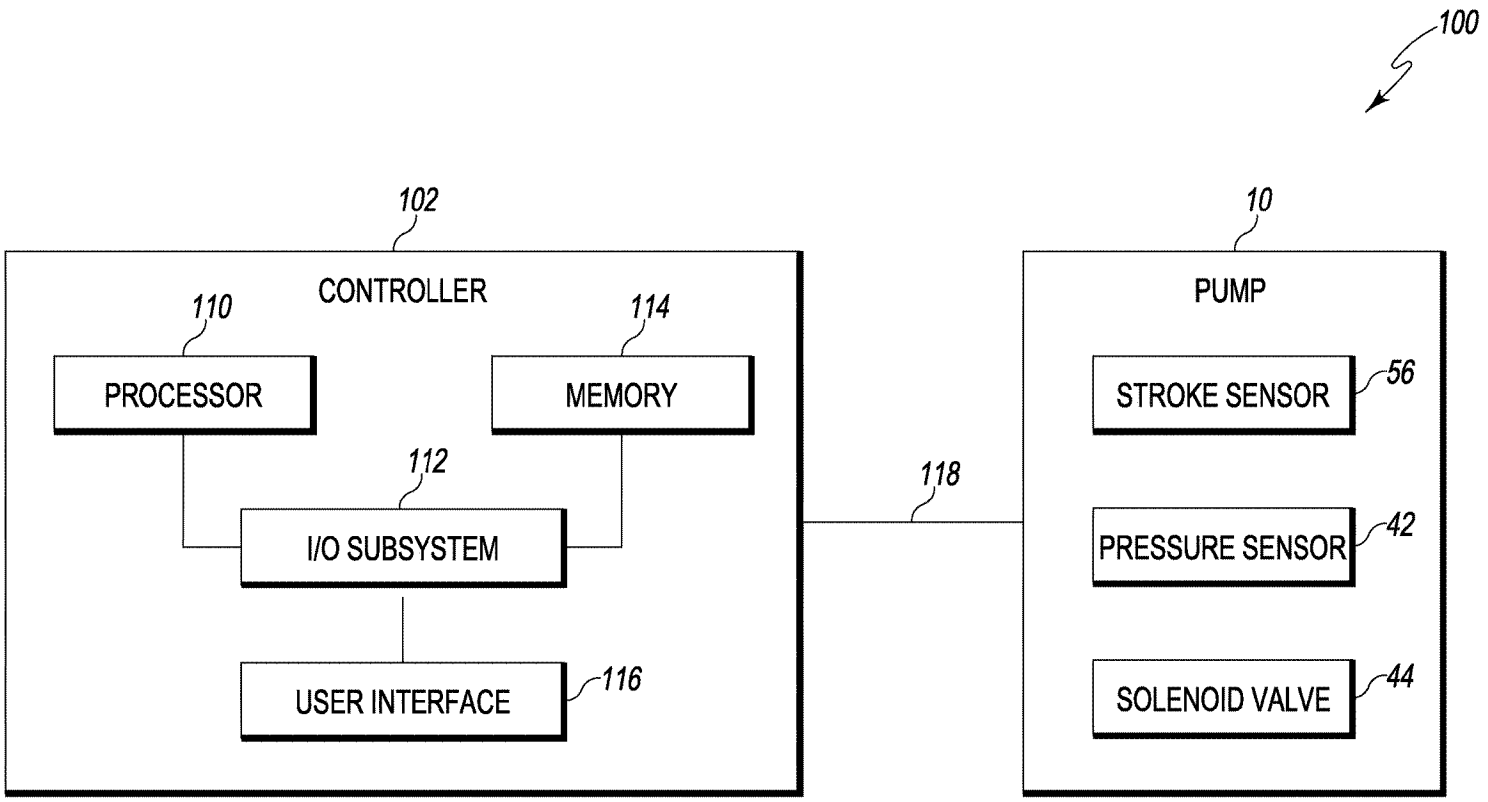
FIG. 3 is a simplified block diagram of at least one embodiment of a pump system including the pump of FIGS. 1 and 2.

Referring now to FIG. 3, one illustrative embodiment of a pump system 100 including the pump 10 of FIGS. 1 and 2 and a controller 102 is shown as a simplified block diagram. As described above, the pump 10 may include a solenoid valve 44, a pressure sensor 42, and a stroke sensor 56. In the illustrative embodiment shown in FIG. 3, the controller 102 is communicatively coupled to the solenoid valve 44, the pressure sensor 42, and the stroke sensor 56 of the pump 10 via one or more wired connections 118. In other embodiments, the controller 102 may be communicatively coupled to the solenoid valve 44, the pressure sensor 42, and the stroke sensor 56 via other types of connections (e.g., wireless or radio links). It should be appreciated that, in some embodiments, the controller 102 may constitute a part of the pump 10. The controller 102 is, in essence, the master computer responsible for interpreting signals sent by sensors associated with the pump 10 and for activating or energizing electronically-controlled components associated with the pump 10. For example, the controller 102 is configured to monitor various signals from the pressure sensor 42 and the stroke sensor 56, to control operation of the solenoid valve 44, and to determine when various operations of the pump system 100 should be performed, amongst many other things. In particular, as will be described in more detail below with reference to FIGS. 4, 5A, and 5B, the controller 102 is operable to identify whether the pump 10 is primed.

To do so, the controller 102 includes a number of electronic components commonly associated with electronic control units utilized in the control of electromechanical systems. In the illustrative embodiment, the controller 102 of the pump system 100 includes a processor 110, an input/output ("I/O") subsystem 112, a memory 114, and a user interface 116. It will be appreciated that the controller 102 may include other or additional components, such as those commonly found in a computing device (e.g., various input/output devices). Additionally, in some embodiments, one or more of the illustrative components of the controller 102 may be incorporated in, or otherwise form a portion of, another component of the controller 102 (e.g., as with a microcontroller).

The processor 110 of the controller 102 may be embodied as any type of processor capable of performing the functions described herein. For example, the processor may be embodied as one or more single or multi-core processors, digital signal processors, microcontrollers, or other processors or processing/controlling circuits. Similarly, the memory 114 may be embodied as any type of volatile or non-volatile memory or data storage device capable of performing the functions described herein. The memory 114 stores various data and software used during operation of the controller 102, such as operating systems, applications, programs, libraries, and drivers. For instance, the memory 114 may store instructions in the form of a software routine (or routines) which, when executed by the processor 110, allows the controller 102 to control operation of the pump 10. The user interface 116 permits a user to interact with the controller 102 to, for example, initiate an automatic priming function of the pump system 100. As such, in some embodiments, the user interface 116 includes a keypad, touch screen, display, and/or other mechanisms to permit I/O functionality.

The memory 114 and the user interface 116 are communicatively coupled to the processor 110 via the I/O subsystem 112, which may be embodied as circuitry and/or components to facilitate I/O operations of the controller 102. For example, the I/O subsystem 112 may be embodied as, or otherwise include, memory controller hubs, I/O control hubs, firmware devices, communication links (e.g., point-to-point links, bus links, wires, cables, light guides, printed circuit board traces, etc.), and/or other components and subsystems to facilitate the I/O operations. In the illustrative embodiment, the I/O subsystem 112 includes an analog-to-digital ("A/D") converter, or the like, that converts analog signals from the pressure sensor 42 and the stroke sensor 56 of the pump 10 into digital signals for use by the processor 110. It should be appreciated that, if any one or more of the sensors associated with the pump 10 generate a digital output signal, the A/D converter may be bypassed. Similarly, in the illustrative embodiment, the I/O subsystem 112 includes a digital-to-analog ("D/A") converter, or the like, that converts digital signals from the processor 110 into analog signals for use by the solenoid valve 44 of the pump 10. It should also be appreciated that, if the solenoid valve 44 operates using a digital input signal, the D/A converter may be bypassed.

Figure 4:
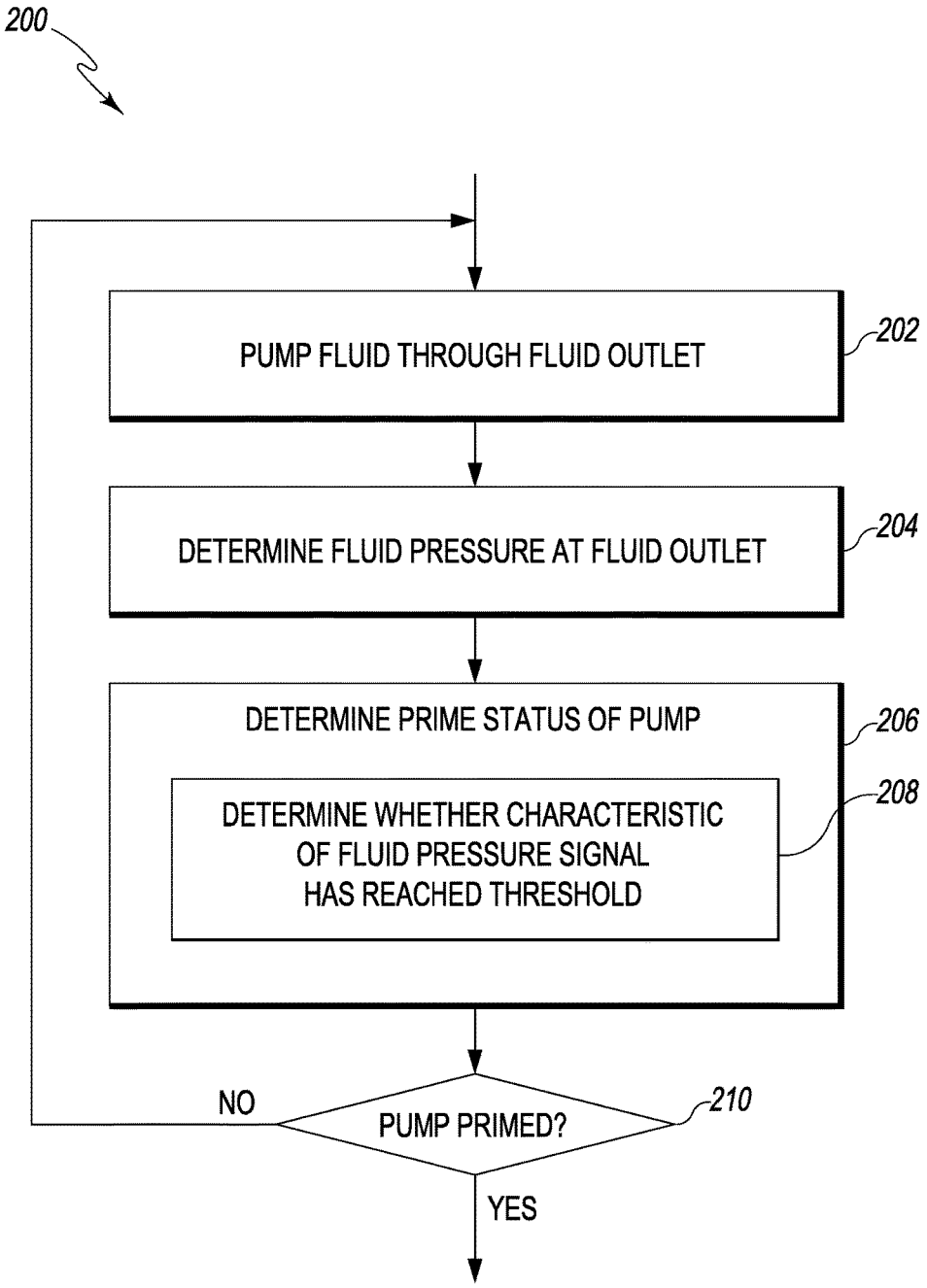
FIG. 4 is a simplified flow diagram of at least one embodiment of a method of priming the pump of FIGS. 1 and 2.

Referring now to FIG. 4, one illustrative embodiment of a method 200 of priming the pump 10 of FIGS. 1 and 2 is shown as a simplified flow diagram. The method 200 represents one illustrative embodiment of an automatic priming function of the pump 10 and the pump system 100. The method 200 may be initiated by a user of the pump system 100 (for instance, by selecting an appropriate input on the user interface 116 of the controller 102) or may be initiated by the controller 102 without user input. The method 200 is illustrated in FIG. 4 as a number of blocks 202-210, which may be performed by various components of the pump system 100 of FIG. 3.

The method 200 begins with block 202 in which the controller 102 transmits a control signal to the pump 10 that causes the pump 10 to pump fluid through the fluid outlet 40. Due to the mechanics of the diaphragm pump 10 described above, the pump 10 may pump fluid at a discontinuous or otherwise non-uniform flow rate, unlike many other types of pumps. As such, in some embodiments, pumping fluid through the fluid outlet 40 in block 202 may comprise transmitting a control signal from the controller 102 to the solenoid valve 44 that causes a single stroke of the pump 10. In other embodiments, block 202 may comprise cycling the pump 10 at least once. It will be appreciated that, until the pump 10 has achieved prime, the fluid being pumped through the fluid outlet 40 in block 202 will be air (and not the fluid supplied to the inlet manifold 38 of the pump 10).

After block 202, the method 200 proceeds to block 204 in which the fluid pressure at the fluid outlet 40 of the pump 10 is determined using the pressure sensor 42. In other words, the pressure sensor 42 of the pump 10 senses the pressure of the fluid being pumped through the fluid outlet 40 and generates a pressure signal associated with the sensed pressure. The pressure sensor 42 may transmit this pressure signal to the controller 102 continuously or intermittently, including, by way of example, in response to a query from the controller 102. It is contemplated that the block 204 may be performed continuously or intermittently during performance of the method 200 (including during the block 202).

After block 204, the method 200 proceeds to block 206 in which the controller 102 determines whether the pump 10 is primed. In the illustrative embodiment, the controller 102 uses the pressure signal generated by the pressure sensor 42 in block 204 to identify whether the pump 10 is primed. In particular, block 206 may involve block 208 in which the controller 102 determines whether a characteristic of the pressure signal received from the pressure sensor 42 has reached a threshold. When the pump 10 reaches prime (i.e., when air has been fully purged from the pump 10 and the fluid supplied to the inlet manifold 38 reaches the fluid outlet 40), the pressure signal generated by the pressure sensor 42 will have a substantially different signature than the pressure signal associated with an unprimed pump 10. As such, various pressure signal characteristics may be used to distinguish between a primed and unprimed state of the pump 10. For example, a differential (i.e., rate of change) of the pressure signal, an average of the pressure signal, a rolling average of the pressure signal, a peak value of the pressure signal, and/or an amplitude of the pressure signal may be compared to a threshold in block 208. When one or more of these characteristics of the pressure signal generated by the pressure sensor 42 reaches (or passes) one or more thresholds, the controller 102 may identify the pump 10 as primed. It is contemplated that any number of pressure signal characteristics may be used in block 208, so the illustrative characteristics listed above should not be regarded as limiting.

After block 206, the method 200 proceeds to block 210 in which the controller 102 determines whether to continue or conclude the method 200 (i.e., the automatic priming function). If the controller 102 determined in block 206 that the pump 10 was not primed, block 210 may involve the controller 102 returning the method 200 to block 202. As such, in the illustrative embodiment of FIG. 4, the method 200 will be repeated until the pump 10 has achieved prime. If the controller 102 instead determined in block 206 that the pump 10 was primed, the controller 102 will conclude the method 200 in block 210. In some embodiments, concluding the method 200 in block 210 may involve the diaphragm pump 10 ceasing to pump fluid through the fluid outlet 40 without losing prime. It will be appreciated that this is not possible in many other types of pumps (e.g., continuous flow pumps) because ceasing to pump fluid will result in a loss of prime. In other embodiments, concluding the method 200 in block 210 may allow the controller 102 to proceed to another control algorithm or function.

Figure 5A:
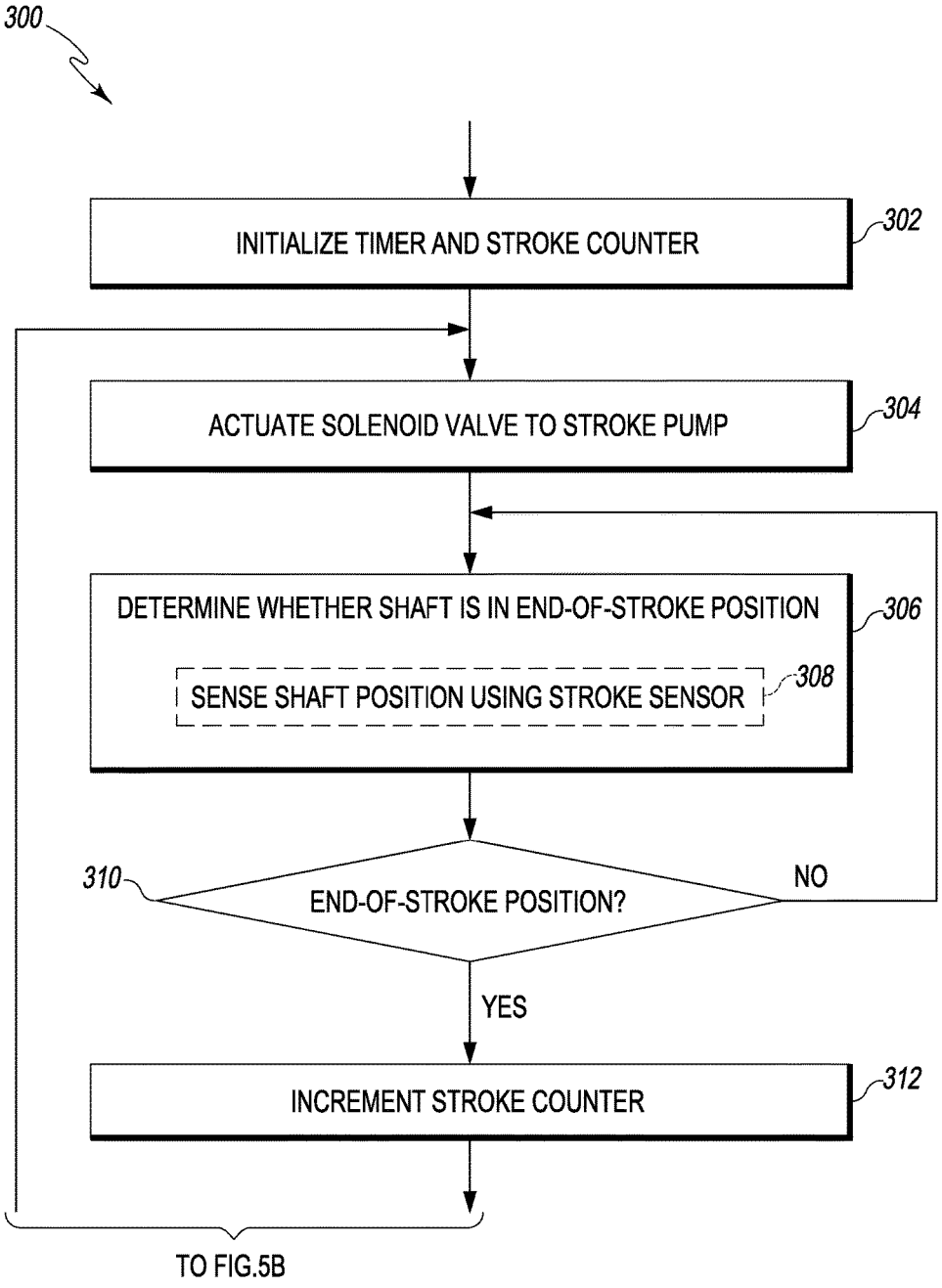
FIGS. 5A and 5B are a simplified flow diagram of at least one other embodiment of a method of priming the pump of FIGS. 1 and 2.
Figure 5B:
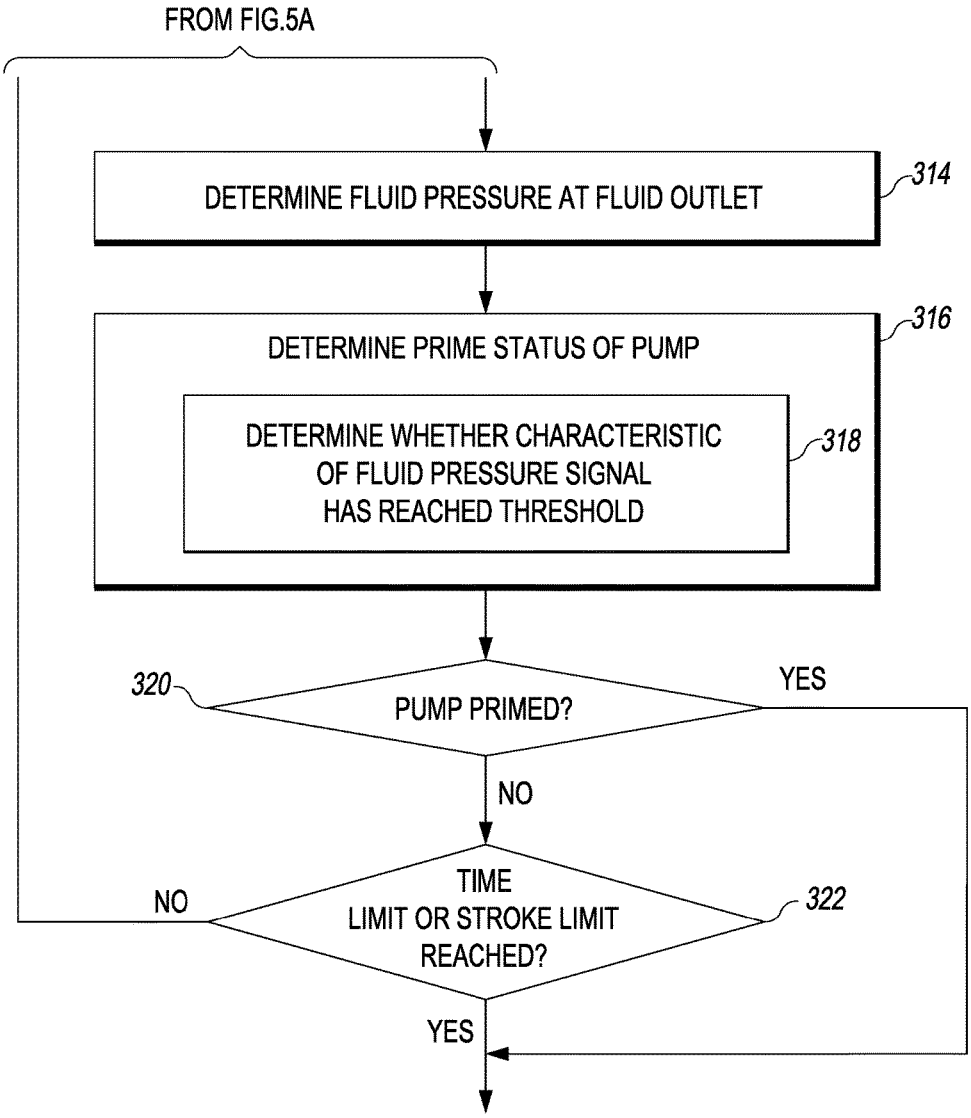

Referring now to FIGS. 5A and 5B, one illustrative embodiment of a method 300 of priming the pump 10 of FIGS. 1 and 2 is shown as a simplified flow diagram. The method 300 represents another illustrative embodiment of an automatic priming function of the pump 10 and the pump system 100. Like the method 200, the method 300 may be initiated by a user of the pump system 100 (for instance, by selecting an appropriate input on the user interface 116 of the controller 102) or may be initiated by the controller 102 without user input. The method 300 is illustrated in FIGS. 5A and 5B as a number of blocks 302-322, which may be performed by various components of the pump system 100 of FIG. 3. While the illustrative embodiment of method 300 shown in FIGS. 5A and 5B utilizes both a timer of the controller 102 and a stroke signal generated by the stroke sensor 56 of the pump 10, it is contemplated that other embodiments of the method 300 may utilize only one of these features. It will be appreciated that, in such alternative embodiments of the method 300, certain of the blocks 302-322 (or portions thereof) may not be included in the method 300.

The method 300 begins with block 302 in which the controller 102 initializes a timer and/or a stroke counter for use in "timing out" the method 300 (i.e., the automatic priming function). In the illustrative embodiment of method 300, a timer of the controller 102 is used to track how long the automatic priming function has been running (e.g., in minutes, seconds, milliseconds, or some other measure of time). As described further below, the method 300 may conclude (and/or other action may be taken) if the timer reaches a time limit prior to the pump 10 reaching prime. Similarly, a stroke counter may be used by the controller 102 to count a number of strokes of the shaft 30 of the pump 10. As described further below, the method 300 may conclude (and/or other action may be taken) if the stroke counter reaches a stroke limit prior to the pump 10 reaching prime. As mentioned above, some embodiments of the method 300 may involve only one of the timer and the stroke counter (and not the other).

After block 302, the method 300 proceeds to block 304 in which the controller 102 transmits a control signal to actuate the solenoid valve 44. As discussed above, actuation of the solenoid valve 44 causes movement of the major valve 34, which supplies motive fluid to one of the motive fluid chambers 26, 28 of the pump 10, thereby stroking the pump 10 (i.e., moving the shaft 30 and diaphragms 18, 20 from one end-of-stroke position to the other end-of-stroke position) and causing fluid to be pumped through the fluid outlet 40.

It will be appreciated that, until the pump 10 has achieved prime, the fluid being pumped through the fluid outlet 40 in block 202 will be air (and not the fluid supplied to the inlet manifold 38 of the pump 10).

After block 304, the method 300 proceeds to block 306 in which the controller 102 determines whether the shaft 30 has reached one of the end-of-stroke positions. In other words, the controller 102 identifies whether the shaft 30 has moved from one end-of-stroke position to the other end-of-stroke position. In the illustrative embodiment shown in FIG. 5A, block 306 involves block 308 in which the stroke sensor 56 (e.g., a proximity sensor, as shown in FIG. 2) senses a position of the shaft 30 and generates a stroke signal associated with the sensed position. In other embodiments, as discussed above, block 306 may involve another type of stroke sensor 56 (e.g., a pressure sensor, an optical sensor, etc.) generating a stroke signal that indicates whether the shaft 30 has reached one of the end-of-stroke positions. The stroke sensor 56 may transmit this stroke signal to the controller 102 continuously or intermittently, including, by way of example, in response to the shaft 30 reaching one of the end-of-stroke positions.

After block 306, the method 300 proceeds to block 310 in which the controller 102 determines whether to repeat the block 306 or continue the method 300. If the controller 102 determined in block 306 that the shaft 30 had yet not reached one of the end-of-stroke positions, block 310 may involve the controller 102 returning the method 300 to block 306. As such, in the illustrative embodiment of FIG. 5A, blocks 306-310 will be repeated until the shaft 30 is in one of the end-of-stroke positions. If the controller 102 instead determined in block 306 that the shaft 30 had reached one of the end-of-stroke positions, the method 300 will proceed to block 312 in which the controller 102 increments the stroke counter.

After block 312, the method 300 proceeds to block 314 in which the fluid pressure at the fluid outlet 40 of the pump 10 is determined using the pressure sensor 42. In other words, the pressure sensor 42 of the pump 10 senses the pressure of the fluid being pumped through the fluid outlet 40 and generates a pressure signal associated with the sensed pressure. The pressure sensor 42 may transmit this pressure signal to the controller 102 continuously or intermittently, including, by way of example, in response to a query from the controller 102. It is contemplated that the block 314 may be performed continuously or intermittently during performance of the method 300 (including during other blocks of the method 300).

After block 314, the method 300 proceeds to block 316 in which the controller 102 determines whether the pump 10 is primed. In the illustrative embodiment, the controller 102 uses the pressure signal generated by the pressure sensor 42 in block 314 to identify whether the pump 10 is primed. In particular, block 316 may involve block 318 in which the controller 102 determines whether a characteristic of the pressure signal received from the pressure sensor 42 has reached a threshold. During blocks 316, 318, the controller 102 may perform similar determinations to those described above with reference to blocks 206, 208 of FIG. 4.

After block 316, the method 300 proceeds to block 320 in which the controller 102 determines whether to continue or conclude the method 300 (i.e., the automatic priming function). If the controller 102 determined in block 316 that the pump 10 was not primed, block 320 may result in the method 300 proceeding to block 322 (described below). If the controller 102 instead determined in block 316 that the pump 10 was primed, the controller 102 will conclude the method 300 in block 320. In some embodiments, concluding the method 300 in block 320 may involve the diaphragm pump 10 ceasing to pump fluid through the fluid outlet 40 without losing prime. Once again, it will be appreciated that this is not possible in many other types of pumps (e.g., continuous flow pumps) because ceasing to pump fluid will result in a loss of prime. In other embodiments, concluding the method 300 in block 320 may allow the controller 102 to proceed to another control algorithm or function.

If the method 300 is not concluded in block 320, the method 300 proceeds to block 322 in which the controller 102 determines whether the value of the timer has reached a time limit and/or whether the value of the stroke counter has reached a stroke limit (and, thus, whether to continue or conclude the method 300). As noted above, the time limit and/or the stroke limit may be used by the controller 102 to prevent the automatic priming function from executing perpetually. Such limits may be implemented to, for example, prevent unnecessary damage or wear to the pump 10. If the controller 102 determines in block 322 that the neither the time limit nor the stroke limit has been reached, block 322 may involve the controller 102 returning the method 300 to block 304 (in which the controller 102 transmits a control signal to actuate the solenoid valve 44 and stroke the pump 10). As such, in the illustrative embodiment of FIGS. 5A and 5B, the method 300 will be repeated until the pump 10 has achieved prime, the time limit has been reached, or the stroke limit has been reached. If the controller 102 instead determines in block 322 that the time limit (where used) has been reached or that the stroke limit (where used) has been reached, the controller 102 will conclude the method 300 in block 322. In some embodiments, block 322 may also involve the controller 102 executing an alarm protocol in response to determining that time limit and/or stroke limit has been reached. The alarm protocol may include, by way of example, displaying a warning message on the user interface 116 of the controller 102 and/or ceasing to pump fluid with the pump 10.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A pump system comprising:

a diaphragm pump including (i) a shaft coupled to a diaphragm and configured to move reciprocally between a first end-of-stroke position and a second end-of-stroke position, (ii) a stroke sensor configured to sense whether the shaft has reached one of the first and second end-of-stroke positions, (iii) a pressure sensor disposed at a fluid outlet of the diaphragm pump and configured to sense a pressure of a fluid pumped by the diaphragm pump, and (iv) a solenoid valve configured to control supply of a motive fluid that causes the shaft to move between the first and second end-of-stroke positions; and a controller communicatively coupled to the diaphragm pump and configured to (i) identify whether the shaft has reached one of the first and second end-of-stroke positions using a stroke signal received from the stroke sensor, (ii) identify whether the diaphragm pump is primed by determining whether a characteristic of a pressure signal received from the pressure sensor has reached a threshold, and (iii) transmit a control signal to the solenoid valve in response to identifying that the shaft is in one of the first and second end-of-stroke positions and that the diaphragm pump is not primed, the control signal actuating the solenoid valve such that the motive fluid causes the shaft to move between the first and second end-of-stroke positions;

wherein when the controller determines that the shaft has not yet reached either of the first or second end-of-stroke positions the controller repeats identifying whether the shaft has reached one of the first and second end-of-stroke positions; and a stroke counter that is incremented by the controller when either of the first or second end-of-stroke positions is detected to determine a stroke limit;

wherein a prime status is detected by the controller when the characteristic of the pressure signal transmitted by the pressure sensor is received from the pressure sensor that the threshold has been reached.

2. The pump system of claim 1, wherein the controller is configured to determine whether the characteristic of the pressure signal has reached the threshold by determining whether at least one of a differential, an average, a rolling average, a peak value, and an amplitude of the pressure signal has reached the threshold.

3. The pump system of claim 1, wherein the controller is configured to determine whether the characteristic of the pressure signal has reached the threshold in response to identifying that the shaft has reached one of the first and second end-of-stroke positions.

4. The pump system of claim 1, wherein the controller is further configured to:

track a number of strokes of the shaft using the stroke signal received from the stroke sensor; and transmit the control signal to the solenoid valve in response to identifying (i) that the shaft is in one of the first and second end-of-stroke positions, (ii) that the diaphragm pump is not primed, and (iii) that the number of strokes of the shaft has not exceeded the stroke limit.

5. The pump system of claim 1, wherein the controller is configured to transmit the control signal to the solenoid valve in response to identifying (i) that the shaft is in one of the first and second end-of-stroke positions, (ii) that the diaphragm pump is not primed, and (iii) that a timer of the controller has not exceeded a time limit.

6. A method of priming a diaphragm pump, the method comprising:

a sensing whether a shaft coupled to a diaphragm has reached an end-of-stroke position using a stroke sensor of the diaphragm pump;

b identifying, on a controller of the diaphragm pump, whether the shaft is in the end-of-stroke position using a stroke signal generated by the stroke sensor;

c sensing a pressure of a pumped fluid at a fluid outlet of the diaphragm pump using a pressure sensor disposed at the fluid outlet;

d actuating a solenoid valve, in response to identifying that the shaft is in the end-of-stroke position and that the diaphragm pump is not primed, to cause a motive fluid to be supplied to the diaphragm such that the shaft moves from the end-of-stroke position;

e initializing a timer and a stroke counter for use in timing out the priming by the controller;

f repeating the identifying, on a controller of the diaphragm pump, whether the shaft is in the end of stroke position if the controller determined that the shaft had not yet reached either of the first or second end-of-stroke positions;

g incrementing the stroke counter by the controller if either of the first or second end-of-stroke positions is detected by the controller to determine a stroke limit;

h determining a prime status by the controller from a received pressure signal transmitted from the pressure sensor by determining whether a characteristic of the pressure signal received from the pressure sensor has reached a threshold; and i executing the steps in sequential order a through h.

7. The method of claim 6, wherein actuating the solenoid valve comprises actuating the solenoid valve in response to identifying (i) that the shaft is in the end-of-stroke position, (ii) that the diaphragm pump is not primed, and (iii) that a number of strokes of the shaft has not exceeded a stroke limit.

8. The method of claim 7, further comprising executing, on the controller, an alarm protocol in response to identifying that the diaphragm pump is not primed and that the number of strokes of the shaft has exceeded the stroke limit.

9. The method of claim 6, wherein actuating the solenoid valve comprises actuating the solenoid valve in response to identifying (i) that the shaft is in the end-of-stroke position, (ii) that the diaphragm pump is not primed, and (iii) that the timer of the controller has not exceeded a time limit.

10. The method of claim 9, further comprising executing, on the controller, an alarm protocol in response to identifying that the diaphragm pump is not primed and that the timer of the controller has exceeded the time limit.

11. The method of claim 6, wherein determining whether the characteristic of the pressure signal has reached the threshold comprises determining whether at least one of a differential, an average, a rolling average, a peak value, and an amplitude of the pressure signal has reached the threshold.

12. A method of automatically priming a diaphragm pump, the method comprising the steps of:

a fluidly connecting the diaphragm pump to a fluid source to introduce fluid into the pump;

b initiating the automatically priming the diaphragm pump function through a controller to begin drawing fluid into the pump from the fluid source;

c initializing a timer and a stroke counter for use in timing out the automatic priming by the controller;

d transmitting a control signal from the controller to actuate a solenoid valve which supplies motive fluid to a motive fluid chamber of the diaphragm pump moving a shaft and diaphragm from a first end-of-stroke position to a second end-of-stroke position;

e determining whether the shaft has reached either the first or second end-of-stroke positions by a stroke sensor that senses a position of the shaft and generates a stroke signal associated with the sensed position;

f transmitting the stroke signal from the stroke sensor to the controller;

g repeating the determining whether the shaft has reached either the first or second end-of-stroke positions by the stroke sensor if the controller determined that the shaft had not yet reached either of the first or second end-of-stroke positions;

h incrementing the stroke counter by the controller if either of the first or second end-of-stroke positions is detected by the controller to determine a stroke limit;

determining fluid pressure at a fluid outlet of the diaphragm pump by a pressure sensor;

j transmitting a pressure signal by the pressure sensor to the controller;

k determining a prime status by the controller from the pressure signal transmitted from the pressure sensor by determining whether a characteristic of the pressure signal received from the pressure sensor has reached a threshold;

l concluding the automatically priming the diaphragm pump function if the controller determined that the diaphragm pump was primed;

m determining, by the controller, whether a value of the timer has reached a time limit and whether the value of the stroke counter has reached the stroke limit if the diaphragm pump is not primed;

n transmitting a control signal from the controller to the solenoid valve in response to determining that neither the time limit nor the stroke limit has been reached;

o repeating steps b through n if the diaphragm pump has not yet achieved prime; and p executing steps in sequential order a through o.

* * * * *